US006730015B2

(12) United States Patent
Schugt et al.

(10) Patent No.: US 6,730,015 B2
(45) Date of Patent: May 4, 2004

(54) FLEXIBLE TRANSDUCER SUPPORTS

(76) Inventors: Mike Schugt, c/o St. Croix Medical, Inc. 5301 E. River Rd., Suite 113, Minneapolis, MN (US) 55421; Clair W. Madsen, c/o St. Croix Medical, Inc. 5301 E. River Rd., Suite 113, Minneapolis, MN (US) 55421; Michael E. Glasscock, III, c/o St. Croix Medical, Inc. 5301 E. River Rd., Suite 113, Minneapolis, MN (US) 55421

( * ) Notice: Subject to any disclaimer, the term of this patent is extended or adjusted under 35 U.S.C. 154(b) by 0 days.

(21) Appl. No.: 09/872,537

(22) Filed: Jun. 1, 2001

(65) Prior Publication Data

US 2002/0183586 A1 Dec. 5, 2002

(51) Int. Cl.[7] ..... H04R 25/00

(52) U.S. Cl. ..... 600/25

(58) Field of Search ..... 600/25; 606/130; 623/10

(56) References Cited

U.S. PATENT DOCUMENTS

| | | | |
|---|---|---|---|
| 3,557,775 | A | 1/1971 | Mahoney |
| 3,594,514 | A | 7/1971 | Wingrove |
| 3,712,962 | A | 1/1973 | Epley |
| 3,870,832 | A | 3/1975 | Fredrickson |
| 3,882,285 | A | 5/1975 | Nunley et al. |
| 3,931,648 | A | 1/1976 | Shea, Jr. |
| 3,992,725 | A | 11/1976 | Homsy |
| 4,052,754 | A | 10/1977 | Homsy |
| 4,150,262 | A | 4/1979 | Ono |
| 4,169,292 | A | 10/1979 | Grote |
| 4,315,433 | A | 2/1982 | Edelman et al. |
| 4,466,690 | A | 8/1984 | Osypka |
| 4,498,461 | A | 2/1985 | Hakansson |
| 4,601,723 | A | 7/1986 | McGrew |
| 4,606,329 | A | 8/1986 | Hough |
| 4,624,672 | A | 11/1986 | Lenkauskas |
| 4,628,907 | A | 12/1986 | Epley |
| 4,696,287 | A | 9/1987 | Hortmann et al. |
| 4,728,327 | A | 3/1988 | Gersdorff |
| 4,729,366 | A | 3/1988 | Schaefer et al. |
| 4,756,312 | A | 7/1988 | Epley |
| 4,774,933 | A | 10/1988 | Hough et al. |
| 4,776,322 | A | 10/1988 | Hough et al. |
| 4,817,607 | A | 4/1989 | Tatge |
| 4,840,178 | A | 6/1989 | Heide et al. |
| 4,850,962 | A | 7/1989 | Schaefer |
| 4,957,478 | A | 9/1990 | Maniglia |
| 4,969,900 | A | 11/1990 | Fleischer |
| 4,988,333 | A | 1/1991 | Engebretson et al. |
| 5,012,520 | A | 4/1991 | Steeger |
| 5,015,224 | A | 5/1991 | Maniglia |

(List continued on next page.)

FOREIGN PATENT DOCUMENTS

| | | |
|---|---|---|
| DE | 39 18 329 A1 | 12/1990 |
| DE | 196 18 961 A1 | 11/1997 |
| DE | 196 38 158 A1 | 4/1998 |
| DE | 196 38 159 A1 | 4/1998 |
| EP | 263 254 A1 | 4/1988 |
| WO | WO 92/08330 | 5/1992 |
| WO | WO 94/17645 | 8/1994 |

OTHER PUBLICATIONS

"Middle Ear Implant: Implantable Hearing Aids," *Advances in Audiology*, vol. 4, M. Hoke Series Editor, Karger, 1–169 (1988).

Dormer, PhD., K.J., et al., "Selection of Biomaterials for Middle and Inner Ear Implants,": *Otolaryngologic Clinics of North America*, 28:17–27 (1995).

(List continued on next page.)

*Primary Examiner*—Max F. Hindenburg
*Assistant Examiner*—Brian Szmal

(57) ABSTRACT

A flexible support device for use in positioning and supporting a device, such as a transducer, in contact with a structure of the ear. The support device positions the device for securing of the device with an adhesive.

17 Claims, 4 Drawing Sheets

U.S. PATENT DOCUMENTS

| | | | | |
|---|---|---|---|---|
| 5,015,225 | A | 5/1991 | Hough et al. | |
| 5,085,628 | A | 2/1992 | Engebretson et al. | |
| 5,163,957 | A | 11/1992 | Sade et al. | |
| 5,217,011 | A | 6/1993 | Bisch | |
| 5,277,694 | A | 1/1994 | Leysieffer et al. | |
| 5,282,858 | A | 2/1994 | Bisch et al. | |
| 5,338,287 | A | 8/1994 | Miller et al. | |
| 5,344,422 | A | 9/1994 | Frigg | |
| 5,360,388 | A | 11/1994 | Spindel et al. | |
| 5,370,689 | A | 12/1994 | Causse | |
| 5,411,467 | A | 5/1995 | Hortmann et al. | |
| 5,456,654 | A | 10/1995 | Ball | |
| 5,498,226 | A | 3/1996 | Lenkauskas | |
| 5,531,787 | A | 7/1996 | Lensinski et al. | |
| 5,554,096 | A | 9/1996 | Ball | |
| 5,558,618 | A | 9/1996 | Maniglia | |
| 5,624,376 | A | 4/1997 | Ball et al. | |
| 5,702,342 | A | 12/1997 | Metzler et al. | |
| 5,762,583 | A | 6/1998 | Adams et al. | |
| 5,776,144 | A | 7/1998 | Leysieffer et al. | |
| 5,788,711 | A | 8/1998 | Lehner et al. | |
| 5,800,336 | A | 9/1998 | Ball et al. | |
| 5,836,863 | A | 11/1998 | Bushek et al. | |
| 5,842,967 | A | 12/1998 | Kroll | |
| 5,857,958 | A | 1/1999 | Ball et al. | |
| 5,906,635 | A | 5/1999 | Maniglia | |
| 5,913,815 | A | 6/1999 | Ball et al. | |
| 5,941,814 | A | 8/1999 | Lehner et al. | |
| 5,999,632 | A | 12/1999 | Leysieffer et al. | |
| 6,001,129 | A | 12/1999 | Bushek et al. | |
| 6,050,933 | A | 4/2000 | Bushek et al. | |
| 6,077,215 | A | 6/2000 | Leysieffer | |
| 6,088,619 | A | 7/2000 | Hein et al. | |
| 6,113,531 | A | 9/2000 | Leysieffer et al. | |
| 6,123,660 | A | 9/2000 | Leysieffer | |
| 6,139,488 | A | 10/2000 | Ball | |
| 6,171,229 | B1 | 1/2001 | Kroll et al. | |
| 6,315,710 | B1 | 11/2001 | Bushek et al. | |
| 6,325,755 | B1 * | 12/2001 | Bushek et al. | 600/25 |

OTHER PUBLICATIONS

Dumon, M.D., T., et al., "Piezoelectric Middle Ear Implant Preserving the Ossicular Chain," *Otolaryngologic Clinics of North America*, 28:173–188 (1995).

Dumon, T., et al., "Piezoelectric Middle Ear Implant: Experimental Results," Abstract of Paper Presented at International Symposium on Electronic Implants in Otology and Conventional Hearing Aids, Walt Disney World Swan, Abstract #35, (Nov. 11–14, 1993).

Frederickson, J.M., et al., "Ongoing Investigations into an Implantable Electromagnetic Hearing Aid for Moderate to Severe Sensorineural Hearing Loss,": *Otolaryngological Clinics of North America*, vol. 28, No. 1, 107–121, (Feb. 1995).

Goode, M.D., R.L., et al., "New Knowledge About the Function of the Human Middle Ear: Development of an Improved Analog Model," *American Journal of Otology*, 15:145–154 (1994).

Goode, M.D., R.L., et al., "The History and Development of the Implantable Hearing Aid," *Otolaryngologic Clinics of North America*, 28:1–16 (1995).

Gyo, K., et al., "Sound Pickup Utilizing an Implantable Piezoelectric Ceramic Bimorph Element: Application to the Cochlear Implant," *American Journal of Otology*, vol. 5, No. 4, 273–276 (Apr. 1984).

Gyo, K., et al., "Stapes Vibration Produced by the Output Transducer of an Implantable Hearing Aid," *Arch Otolaryngology Head Neck Surg.*, vol. 113, 1078–1081 (Oct. 1987).

Jako, G., "Biomedical Engineering in Ear Surgery," *Otolaryngological Clinics of North America*, vol. 5, No. 1, 173–182, (Feb. 1972).

Ko, Wen H., et al., "Engineering Principles of Mechanical Stimulation of the Middle Ear," *Otolaryngological Clinics of North America*, vol. 28, No. 1, 29–41 (Feb. 1995).

Ko, PhD., W.H., "A Preliminary Study on the Implantable Middle Ear Hearing Aid," *I.E.E.E. 9th Annual Conference on Engineering in Medicine and Biology Society*, (1987).

Kodera, K., et al., Sound Evaluation of Partially Implantable Piezoelectric Middle Ear Implant: Comparative Study of Frequency Responses,: *ENT Journal*, vol. 73, No. 2, 108–111, (Feb. 1994).

Lenkauskas, El, "Totally Implantable Hearing Aid Device," *Transplants and Implants in Otology II*, 371–375 (1991).

Maniglia, A.J., et al., "A Contactless Electromagnetic Implantable Middle Ear Device for Sensorineural Hearing Loss," *ENT Journal*, vol. 73, No. 2, 78–90, (Feb. 1994).

Maniglia, A. J., et al., "Contactless, Semi–Implantable Electromagnetic Hearing Device for the Treatment of Sensorineural Hearing Loss," *Abstract from Paper Presented at International Symposium on Electronic Implants in Otology and Conventional Hearing Aids*, Walt Disney World Swan, Abstract #29, (Nov. 11–14, 1993).

Maniglia, A.J., et al., "Contactless Semi–Implantable Electromagnetic Middle Ear Device for the Treatment of Sensorineural Hearing Loss: Short–Term and Long–Term Animal Experiments,": *Otolaryngologic Clinics of North America*, 28:121–140, (1995).

Maniglia, M.D., A.J., et al., "Electromagnetic Implantable Middle Ear Hearing Device of the Ossicular–Stimulating Type Principles, Designs, and Experiments," *Ann. Otol. Rhinol Laryngol*, 97 (Suppl. P. 1136), Part 2, (1988).

Maniglia, M.D., A.J., "Implantable Hearing Devices: State of the Art," *Otolaryngologic Clinics of North America*, 22:175–200, (1989).

Ohno, T., "The Implantable Hearing Aid," *Audecibel*, Fall 1984, Winter 1985 (1984).

Onchi, Y., Mechanism of the Middle Ear, *Journal of the Acoustical Society of America*, 33:794–805 (1961).

Riggs, M.T., "Powered Incus Replacement Prosthesis (SBIR Grant Application)", Letter, (1983).

Snik, PhD., Ad F.M., et al., "The Bone–Anchored Hearing Aid Compared with Conventional Hearing Aids: Audiologic Results and the Patients' Opinions," *Otolaryngologic Clinics of North America*, 28:73–83 (1995).

Suzuki, J.I., et al., "Implantation of Partially Implantable Middle Ear Implant and the Indication," *Advances in Audiology*, (Karger, Basel), 4:160–166 (1988).

Suzuki, Jun–Ichi, et al., "Long–Term Clinical Results of the Partially Implantable Piezoelectric Middle Ear Implant," *ENT Journal*, vol. 73, No. 2, 104–107, (Feb. 1994).

Suzuki, J.I., et al., "Principle, Construction and Indication of the Middle Ear Implant," *Advances in Audiology*, 4:15–21, (1988).

Suzuki, M.D., J.I., et al., "Partially Implantable Piezoelectric Middle Ear Hearing Device: Long–Term Results," *Otolaryngologic Clinics of North America*, 28:99–106 (1995).

Tjellstroom, M.D., PhD., A., "The Bone–Anchored Hearing Aid: Design Principles, Indications, and Long–Term Clinical Results," *Otolaryngologic Clinics of North America* 28:53–72 (1995).

Tos; M., et al., "Implantable of Electromagnetic Ossicular Replacement Device," *ENT Journal*, vol. 73, No. 2, 93–103, (Feb. 1994).

Welling, D.B., et al., "Auditory Stimulation of the Inner Ear via the Semicircular Canals," Abstract of paper presented at International Symposium on Electronic Implants in Otology and Conventional Hearing Aids, Walt Disney World Swan, Abstract #9, (Nov. 11–14, 1993).

Wengen, A., M.D.,D.F., et al., "Measurement of the Stapes Superstructure," *Ann. Otol. Rhinol. Laryngology*, 104–:311–316 (1995).

Wilpizeski, PhD., C., et al., "A Simple Implantable Electromechanical Middle Ear," Transactions of the Pennsylvania Academy of Ophthalmology and Otolaryngology, 32:41–46, (1979).

Yanagihara, N., et al., "Partially Implantable Hearing Aid using Piezoelectric Ceramic Ossicular Vibrator," Abstract of Paper Presented at International Symposium on Electronic Implants in Otology and Conventional Hearing Aids, Walt Disney World Swan, Abstract #26, (Nov. 11–14, 1993).

Yanagihara, M.D., N., et al., "Partially Implantable Hearing Aid Using Piezoelectric Ceramic Ossicular Vibrator," *Otolaryngologic Clinics of North America*, 28:85–97 (1995).

Yanagihara, M.D., N., et al., "Perception of Sound Through Direct Oscillation of the Stapes Using a Piezoelectric Ceramic Bimorph,": *Ann. Otol. Rhinol. Laryngol.*, 92:223–227 (1983).

Yanagihara, M.D., N., et al., "Development of an Implantable Hearing Aid Using a Piezoelectric Vibrator of Bimorph Design: State of the Art," *Otolaryngology Head and Neck Surgery*, 92:706–712 (1984).

Yanagihara, M.D., N., et al., "Implantable Hearing Aid," *Archives of Otolaryngology Head and Neck Surgery*, 113:869–872 (1987).

* cited by examiner

FLEXIBLE TRANSDUCER SUPPORTS

FIELD OF THE INVENTION

This invention relates to a device for mounting components to a structure of the ear for use in a hearing aid system.

DESCRIPTION OF RELATED ART

In a patient with normally functioning anatomical hearing structures, sound waves are directed into an ear canal by the outer ear and into contact with the tympanic membrane. The tympanic membrane is located at the terminus of the ear canal. The pressure of the sound waves vibrates the tympanic membrane resulting in the conversion to mechanical energy. This mechanical energy is communicated through the middle ear to the inner ear by a series of bones located in the middle ear region. These bones of the middle ear are generally referred to as the ossicular chain, which includes three primary components, the malleus, the incus and the stapes. These three bones must be in functional contact in order for the mechanical energy derived from the vibration of the tympanic membrane to be transferred through the middle ear to the inner ear.

Implantable devices are often useful for assisting with hearing. Such devices include partial middle ear implantable or total middle ear implantable devices, cochlear implants, and other hearing assistance systems that use components disposed in the middle ear or inner ear regions. These components may include an input transducer for receiving sound vibrations or an output stimulator for providing mechanical or electrical output stimuli based on the received sound vibrations. Piezoelectric transducers are one example of a class of electromechanical transducers that require contact to sense or provide mechanical vibrations. For example, the piezoelectric input transducer in U.S. Pat. No. 4,729,366, issued to D. W. Schaefer on Mar. 8, 1998, contacts the malleus for detecting mechanical vibrations. In another example the piezoelectric output transducer in the '366 patent contacts the stapes bone or the oval or round window of the cochlea.

Devices for assisting the hearing impaired patient range from miniaturized electronic hearing devices which can be adapted to be placed entirely within the auditory canal, or implantable devices which can be completely or partially implanted within the skull. For those hearing systems, or portions of hearing systems, that require complete subcranial implantation, a challenge has existed to adapt the implantable device for optimal mounting to the unique patient morphologies (including both naturally occurring as well as those created by surgical processes) among patients. Known implantable devices that have elements which perform a support or mounting function are typically rigidly mounted to a bone within the middle ear region. Difficulties have arisen with the use of implantable devices in facilitating the fine adjustments necessary to properly position and configure the support assembly and attached transducers so as to contact an auditory element and thus vibrate a portion of the ossicular chain. Such devices present a particular problem in that positioning, or docking, of the transducer against the auditory element in this stable configuration requires extremely fine adjustments that are difficult given the location of the auditory elements and the attendant's lack of maneuvering room.

A middle ear implantable hearing assistance system typically includes, at least, an input device, such as a sensor transducer, an output device, such as a driver transducer, and some means for electrically connecting the devices and coupling at least one device to an element of the middle ear. The transducer is coupled to and communicates with the middle ear element via a mechanical coupling. The mechanical coupling is critical to the efficacy of the hearing assistance system. Proper positioning of the transducer and good contact between the transducer and ossicle is essential to properly transducing the received mechanical vibrations into a resulting electrical signal for hearing assistance processing (in the case of a sensor transducer) or communicating to the ossicle the mechanical vibration transduced from the electrical signal (in the case of a driver transducer).

It is unclear whether too much force between the transducer and the ossicle, for example the malleus, can mechanically load the vibrating malleus and attenuate the desire mechanical vibration signal or alter its frequency characteristics. It may be likely that, in an extreme case, too much force can damage or break either the malleus or the transducer. It may also be likely that too little force between the transducer and the malleus may be insufficient to detect the mechanical vibration signal, and is more likely to result in a complete loss of signal detection if the transducer and the malleus become dissociated.

Positive fixation is when a device accommodates the morphology of the ossicle or tissue which it is connecting (directly or indirectly). Many prior art devices do not account for the morphological differences of each patient. Such prior art devices either harm the patient by not taking into account, fully, the detrimental impact on tissue patency caused by its structural method of attachment, are nonfunctional, or lose functioning ability with drops of pressure. Specifically, when a transducer is too loosely coupled to the ossicle, there is no signal and, conversely, when a transducer is too tightly coupled to the ossicle, there may be a less than optimum frequency response or harm to the tissue.

Prior art coupling mechanisms used, for example, in coupling a transducer to an ossicle, have a variety of problems. Biasing or crimping have commonly been used to attach to an ossicle. Biasing may result in a connection which is too loose because of the difficulty in determining the extent of the biasing. Over a patient's lifespan, muscles, tissue, and ligaments may stretch and cause the biasing to become loose. Additionally, even if the biased element is not loose during everyday activity, it may become loose and lose contact altogether with a change in pressure, such as in an elevator or an airplane. Crimping has similar problems. It is difficult to determine when the element has been adequately crimped to the ossicle. If the element is too tightly crimped to the ossicle, the blood vessels lose patency and bone rotting to occur. If the element is too loosely crimped to the ossicle, there may be resonances and a poor frequency response.

Similar problems occur when coupling an ossicle to a passive prosthesis. A passive prosthesis is used when one or more of the malleus, incus, or stapes is partially or completely removed or damaged. The passive prosthesis maintains functional contact to transfer the mechanical energy derived from the vibration of the tympanic membrane through the middle ear to the inner ear.

While using an adhesive results in positive coupling with an ossicle, the procedures for securing the transducer or prosthesis to the ossicle are frequently time consuming and technically challenging. In the case of a transducer, the transducer must be positioned with mechanical contact to the ossicle. In positioning the transducer, a physician frequently grasps the transducer with forceps and uses the forceps to maneuver the transducer. The forceps and transducer is often large and unwieldy in the relatively small middle-ear space.

After positioning, the adhesive must be applied to the contact region of the transducer to the ossicle. Adhesives have a setting or curing time during which the transducer must remain in substantially the same position. Thus, the transducer must be remain substantially stable for, generally, at least 15 minutes. This can pose a challenge to a physician who is manually holding the transducer in place with forceps.

Similarly, it is in technically challenging to place and adhere a bracket to the mastoid floor. Typically, a bracket is used to hold a transducer in contact with a transducer and is mounted on and adhered to the mastoid floor. A common method for adhering the brackets is to use an adhesive wherein the adhesive is injected into the area and the bracket is then held in the adhesive with forceps. This method requires the bracket to be held in substantially the same position until the cement sets.

The support device of the present invention is of particular use in the positioning and supporting of devices to be in contact with a structure of the ear.

SUMMARY OF THE INVENTION

To address the difficulties noted above, the present invention provides a device for more effectively and accurately positioning and supporting an element for contact with a structure of the ear. While reference is made explicitly to mounting a transducer to an ossicle, it should be apparent to those skilled in the art that the device could be used for coupling any desired device to an auditory element of the ear.

A flexible support for aid in positioning elements in contact with an auditory element is described. The present invention utilizes a flexible device to support and position a transducer against the ossicle. The device may be used equally well in positioning a passive prosthesis or similar device.

The device involves a flexible element having two ends. The first end is detachably affixed to the transducer (or other element to be positioned). The second end is configured as a mount attachable to a base, for example along the mastoid cavity. In positioning the transducer, the mount is attached to the base via a fastener, for example a screw. The flexible element may then be manipulated to position the transducer as desired. Once in position, the flexible element is rigid enough to support the transducer in position without further instrumentation. Thus, adhesive can be applied and the flexible element will maintain position of the transducer as the adhesive cures. After positioning and adhering of the transducer, the flexible element is disconnected from the transducer and removed from the base.

DETAILED DESCRIPTION OF PREFERRED EMBODIMENTS

Figure 1:
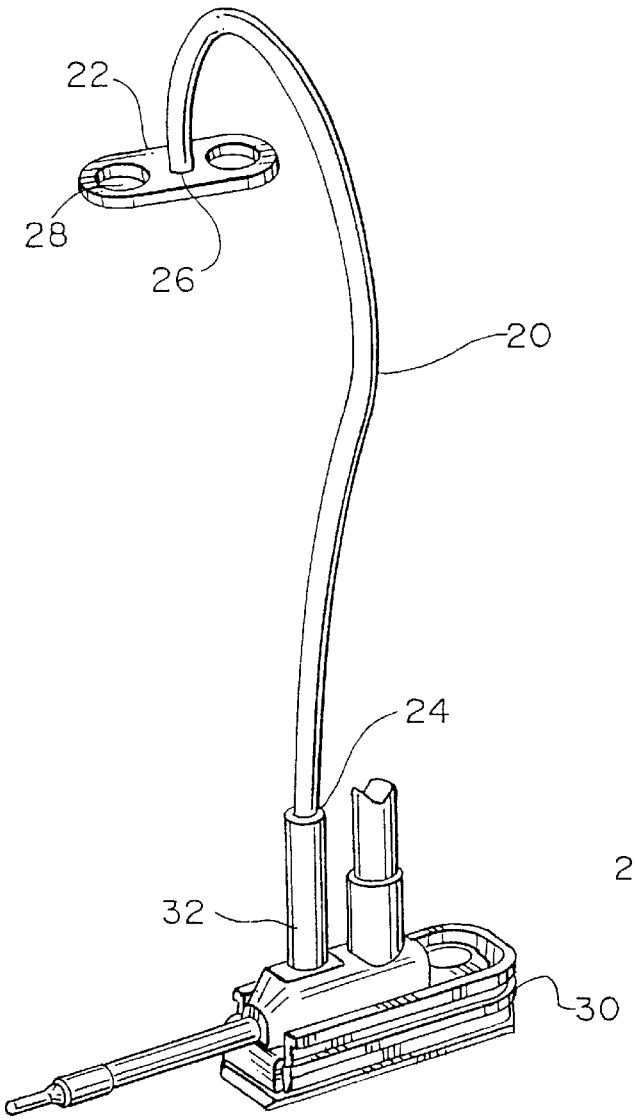
FIG. 1 is a perspective view of one embodiment of the current invention.

It will be understood that the drawings are intended to teach a preferred embodiment of the present invention but are not intended to limit the invention thereto.

The invention provides a device for effectively and accurately positioning and supporting an element for contact with a structure of the ear. The device is particularly advantageous when used in a middle ear implantable hearing system such as a partial middle ear implantable (P-MEI), total middle ear implantable (T-MEI), or other hearing aid system. A P-MEI or T-MEI hearing aid system assists the human auditory system in converting acoustic energy contained within sound waves into electrochemical signals delivered to the brain and interpreted as sound.

The following is a description of a normal human auditory system. Sound waves are directed into an external auditory canal by an outer ear (PINNA). The frequency characteristics of the sound waves are slightly modified by the resident characteristics of the external auditory canal. These sound waves impinge upon a tympanic membrane (eardrum), interposed at the terminus of the external auditory canal, between it and the tympanic cavity (middle ear). Variations of the sound waves produce tympanic vibrations. The mechanical energy of the tympanic vibrations is communicated to the inner ear, comprising cochlea, vestibule, and semi-circular canals by a sequence of articulating bones located in the middle ear. This sequence of articulating bones is referred to generally as the ossicular chain. Thus, the tympanic membrane and the ossicular chain transform acoustic energy and the external auditory canal to mechanical energy at the cochlea.

The ossicular chain includes three primary components: a malleus, an incus, and a stapes. The malleus includes manubrium and head portions. The manubrium of the malleus attaches to the tympanic membrane. The head of the malleus articulates with one end of the incus. The incus normally couples mechanical energy from the vibrating malleus to the stapes. The stapes includes a capitulum portion, comprising a head and a neck, connected to a foot plate portion by means of a support crus comprising two crura. The stapes disposed in and against a membrane covered opening on the cochlea. This membrane-covered opening between the cochlea and middle ear is referred to as the oval window. The oval window is considered part of the cochlea in this patent application. The incus articulates the capitulum of the stapes to complete the mechanical transmission path.

Normally, tympanic vibrations are mechanically conducted through the malleus, incus, and stapes to the oval window. Vibrations at the oval window are conducted into fluid-filled cochlea. These mechanical vibrations generate fluidic motion, thereby transmitting hydraulic energy within the cochlea. Pressures generated in the cochlea by fluidic motion are accommodated by a second membrane covered opening of the cochlea. The second membrane covered opening between the cochlea and the middle ear is referred to as the round window. The round window is considered part of the cochlea in this patent application. Receptor cells in the cochlea translate the fluidic motion into neural impulses which are transmitted to the brain and received as sound. However, various disorders of the tympanic membrane, ossicular chain, and/or cochlea can disrupt or impair normal hearing.

Hearing loss due to an inability to conduct mechanical vibrations through the middle ear is referred to as a conductive hearing loss. Some patients have an ossicular chain lacking sufficient resiliency to transmit mechanical vibrations between the tympanic membrane and the oval window. As a result, fluidic motion in the cochlea is attenuated. Thus, receptor cells in the cochlea do not receive adequate mechanical stimulation. Damaged elements of the ossicular chain may also interrupt transmission of mechanical vibrations between the tympanic membrane and the oval window.

Implantable hearing aid systems have been developed, utilizing various approaches to compensate for hearing disorders. A particularly interesting class of hearing aid systems includes those which are configured for disposition principally within the middle ear space. The middle ear implantable (MEI) hearing aids typically use an electromechanical input transducer to convert mechanical vibrations received from an ossicle, for example the malleus, to electrical signals. Note however, that if desired, an acoustic microphone could be used in lieu of an electromechanical input transducer and may positioned in the middle ear or the outer ear. An electromechanical output transducer, converts the electrical signals from the input transducer into mechanical vibrations. The electromechanical output transducer communicates these mechanical vibrations to an ossicular bone, for example the stapes. The ossicular chain, is optionally interrupted to allow coupling of the mechanical vibrations to the ossicular chain.

Both electromagnetic and piezoelectric output transducers have been used to communicate the mechanical vibrations to the ossicular chain. One example of a piezoelectric output transducer capable of communicating mechanical vibrations through the ossicular chain is disclosed in U.S. Pat. No. 4,729,366 issued to D. W. Schaefer on Mar. 8, 1988. In the '366 patent, a mechanical-to-electrical piezoelectric input transducer is associated with the malleus, transducing mechanical energy into an electrical signal, which is amplified and further processed. The resulting electrical signal is provided to an electrical-to-mechanical piezoelectric output transducer that generates a mechanical vibration coupled to an element of the ossicular chain or to the oval window or round window. In the '366 patent the ossicular chain is interrupted by removal of the incus. Removal of the incus prevents the mechanical vibrations delivered by the piezoelectric output transducer from mechanically feeding back to the piezoelectric input transducer.

A critical factor in the processing of sound through such a middle ear implantable system is the quality of connection between the transducers and the ossicular bones. A transducer can be coupled to the ossicular bone either directly or indirectly. Directly coupling a transducer to the middle bone involves biasing. Effectively biasing the transducer against an ossicular bond has proved problematic. The extent of the biasing is often difficult to determine, frequently resulting in loose biasing. It has been shown that a biased transducer will often become loose with a change in pressure, such as in an elevator or an airplane. Also even if the biasing is initially effective, muscles, tissue and ligaments may stretch and cause the biasing to become loose and the hearing aid to become temporarily nonfunctional.

Transducers have also been coupled to ossicular bones indirectly using a coupling element crimped to the bone. The difficulty of determining the extent of crimping makes crimping problematic. If the element is too tightly crimped to the ossicle, the blood vessels lose patency and bone rotting to occur. If the element is too loosely crimped to the ossicle, there may be resonances and a poor frequency response.

A transducer can be directly coupled to an ossicle with an adhesive to achieve positive fixation. However, properly positioning the adhesive can be difficult because of the time needed for the adhesive to cure. While the adhesive is to curing, the transducer must be held in position in contact with the ossicle. Further, the transducer are preferably held in position at the point where the mechanical vibrations will be most effectively transduced to or from the ossicle. Traditionally, transducers are positioned by grasping the transducer with forceps and maneuvering the forceps and transducer in the small middle ear cavity. This procedure can be awkward and, even when proper position is attained, maintaining the position during the curing time is challenging.

There is no existing mechanical means to easily and effectively position a transducer to an ossicle for setting an adhesive. To address this need, the present invention utilizes a flexible device to support and position a transducer against the ossicle. The device may be used equally well in positioning a passive prosthesis or similar device.

The fixation device of the present invention is intended to engage an auditory element of the middle or inner ear to provide positive fixation to that element. The device may be used to couple the auditory element to a transducer, passive prosthesis, or any other desired structure.

As seen in FIG. 1, the device involves a flexible element 20 having two ends 22 and 24. The flexible element is optionally constructed of gold, silver, platinum, titanium, lead, or any alloy or other material that is relatively soft and malleable but retains shape sufficiently to support a device in position in contact with an ossicle. The first end 24 of the flexible element 20 is detachably affixed to the transducer 30 (or other element to be positioned) via a connection 32. The second end 22 is configured as a mount attachable to a base, for example the mastoid cavity. It may therefore be desirably to attach a mounting plate 26 or other mounting means to the second end 22.

In positioning the transducer, the mount is attached to the base via a fastener, for example a screw. Thus, in the embodiment shown in FIG. 1, two openings 28 are provided in the mounting plate 26 for accommodating bone screws. After attachment to the base, the mounting plate 26 provides support for positioning the transducer 30. The flexible element 22 may be manipulated to position the transducer as desired. Once in position, the flexible element 22 is rigid enough to support the transducer 30 in position without further instrumentation. The flexible element is also sufficiently malleable to allow micro manipulation and flexible positioning of the transducer 30.

When the transducer 30 is positioned as desired, an adhesive can be applied and the flexible element 22 will maintain position of the transducer as the adhesive cures.

After positioning and adhering of the transducer 30 to the ossicle, the flexible element 20 may be removed from the middle ear space. The first end 24 is disconnected from the transducer 30. The connection 32 between the first end 24 and the transducer 30 may be of any configuration that is detachable. Optionally, the connection 32 may include a quick-disconnect feature. Alternately, the connection 32 may be electromagnetic, threaded, pin and socket joint, or vacuum connected. Further, it is possible to simply cut the connection 32 using standard cutting techniques. The second end 22 is detached from the base. If bone screws are used, the screws are simply taken out and the mounting plate lifted from the base.

Alternately, if the support member is manufactured of medical grade alloy or material, it may be left implanted in the middle ear space.

Figure 2:
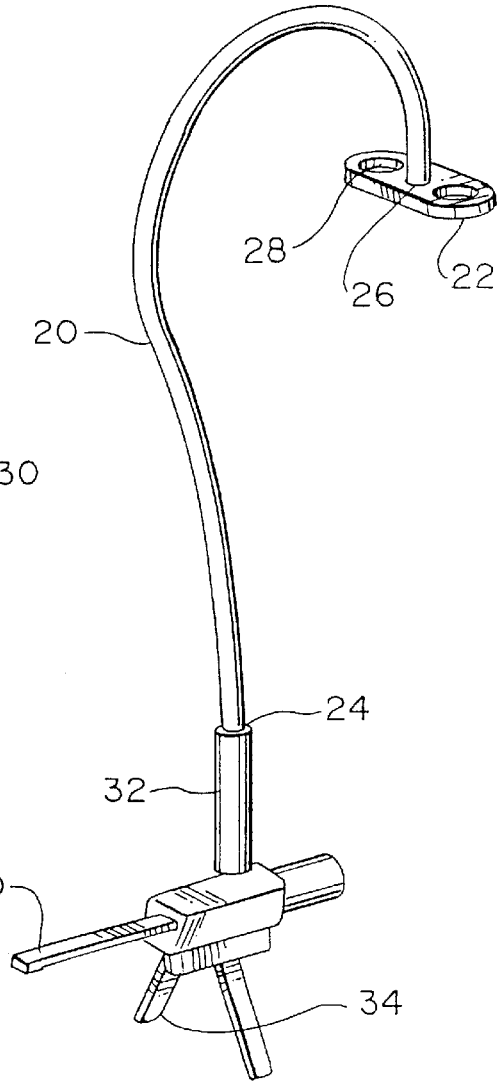
FIG. 2 is a perspective view of an alternate embodiment of the current invention.

FIG. 2 depicts an alternate embodiment wherein the first end 24 includes legs 34. The legs 34 are manufactured of malleable material such that they may be bent to conform to the mastoid floor. In positioning the transducer 30, the legs 34 may be bent along the mastoid floor in order to provide anchoring in the adhesive. This embodiment is especially useful in positioning an electromechanical output transducer.

Figure 3:
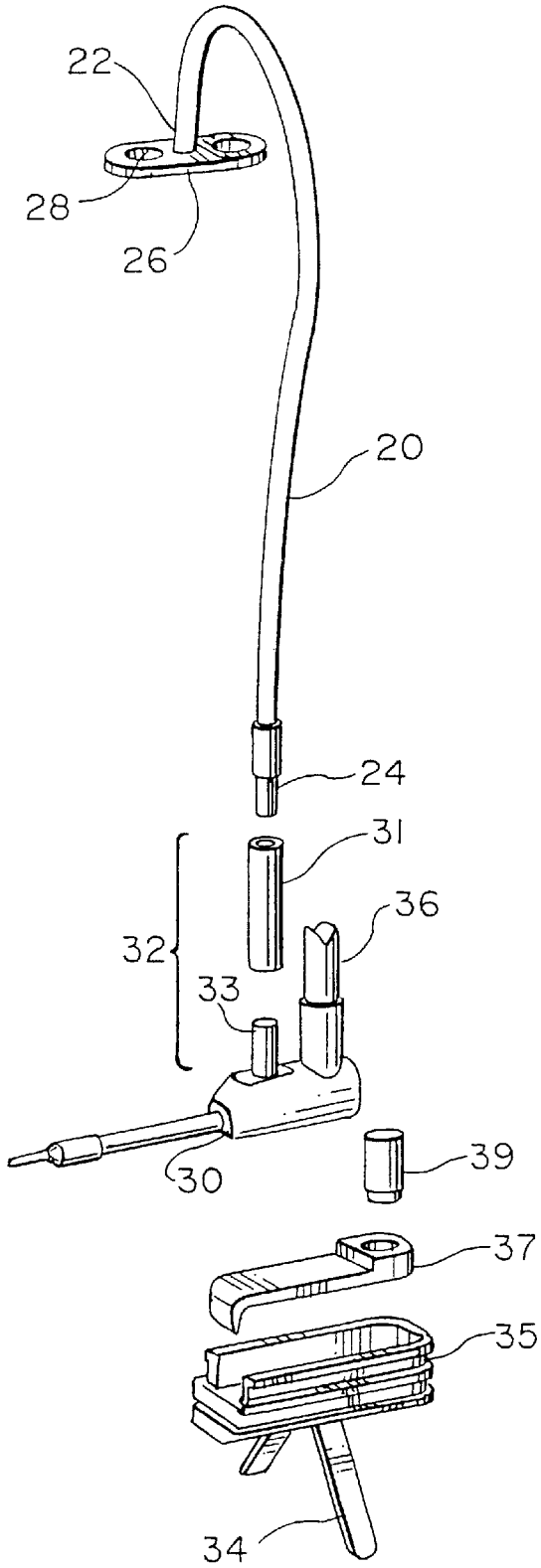
FIG. 3 is an exploded view of the embodiment shown in FIG. 2.

FIG. 3 shows an exploded view of support assembly of FIG. 2. The flexible support 20 attaches to the connection assembly 32 at its first end 24. The connection assembly of this particular embodiment includes a holder 33 positioned on the transducer 30 and a tube 31 that fits over the first end 24 and the holder 33. The tube 31 may optionally be manufactured from silicone rubber. The legs 34 are attached to the transducer with an assembly made up of a base 35 surrounding a plate 37. The plate 37 supports the transducer 30 and a set screw 39 extends through the plate and contacts the transducer 30. As seen in this figure, lead 36 is also affixed to the transducer 30.

Figure 4:
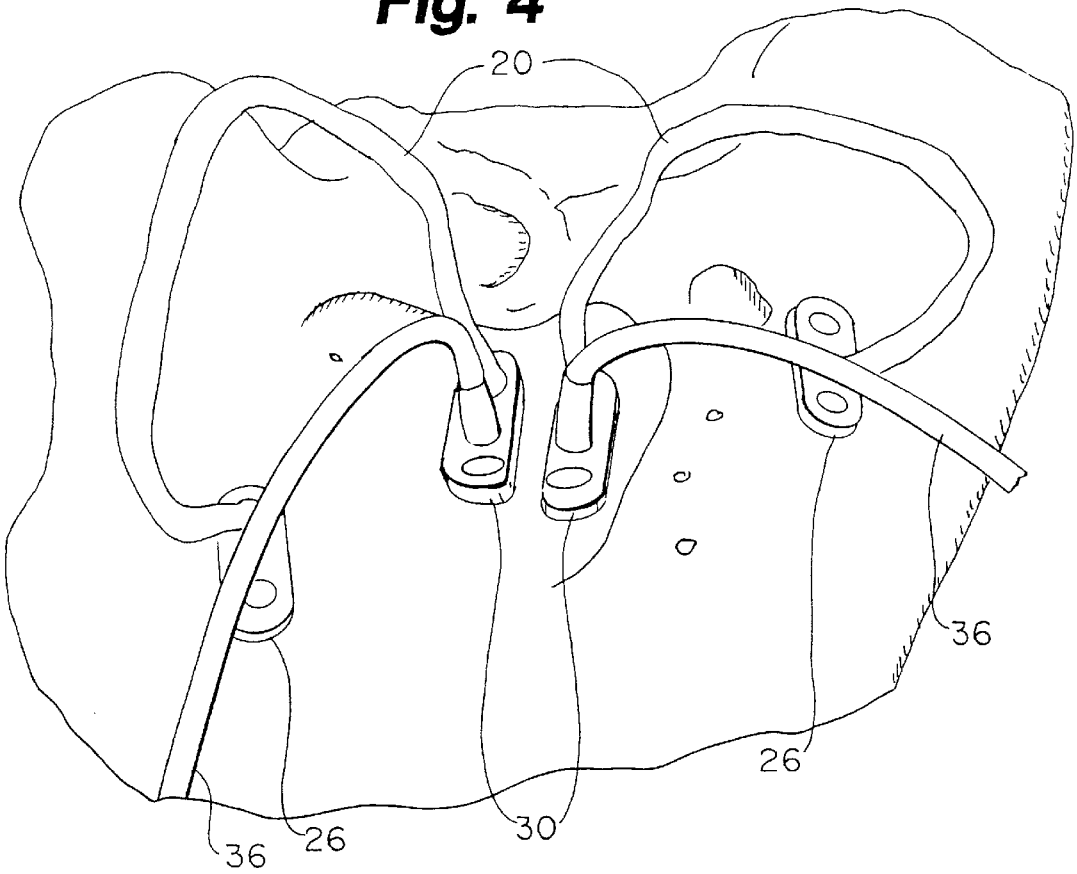
FIG. 4 is a top view of an embodiment of the current invention.

As seen in FIG. 4, input and output transducers 30 may be positioned in the same middle ear space using a flexible element 20 connected to each transducer. Thus, each transducer 30 may be positioned and maintained in position by its associated flexible element and an adhesive may be simultaneously applied to both transducers. FIG. 4 also illustrates leads 36 attached to the transducers 30.

Figure 5:
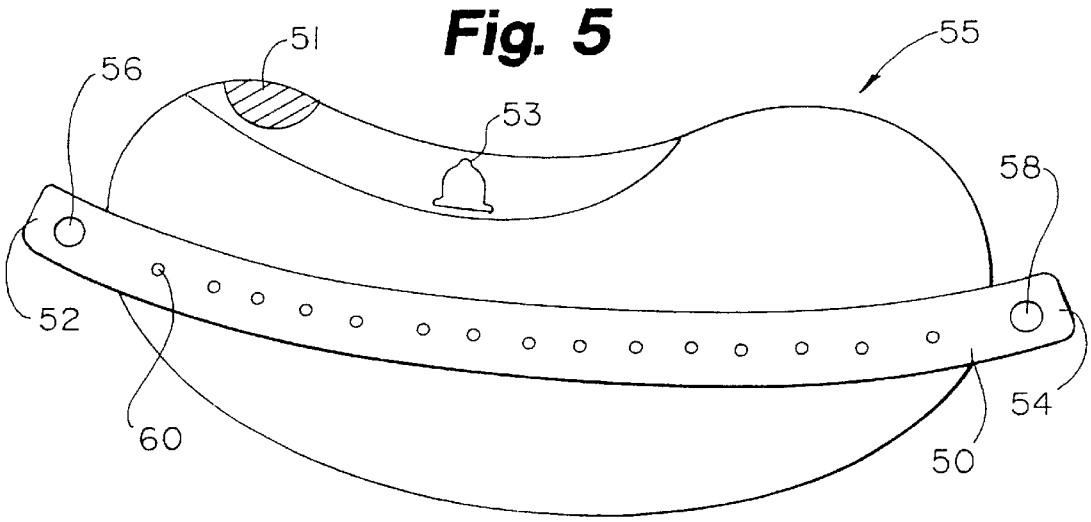
FIG. 5 is a perspective view of an alternate embodiment of the current invention without supported devices.
Figure 6:
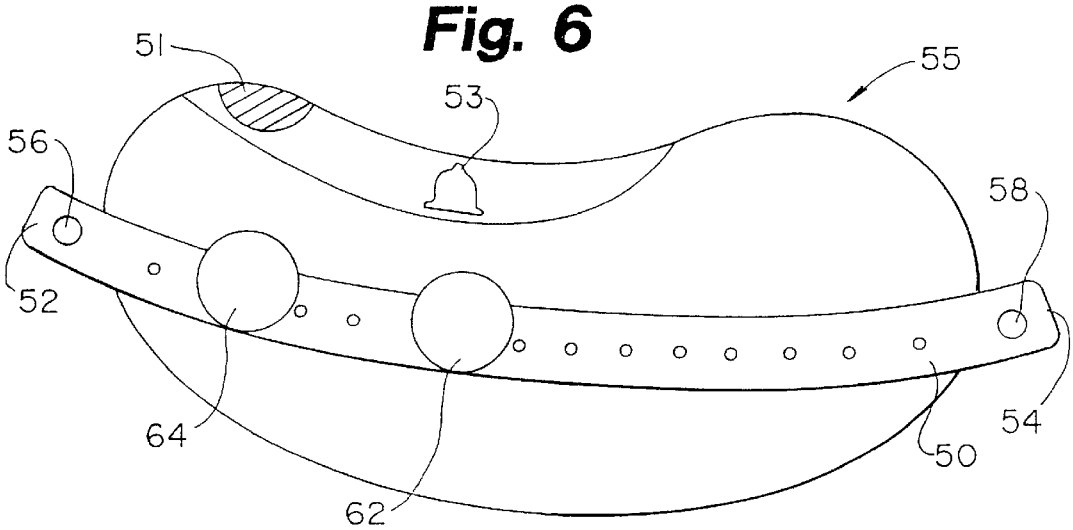
FIG. 6 is a perspective view of the embodiment of FIG. 5 showing positions for the supported devices.
Figure 7:
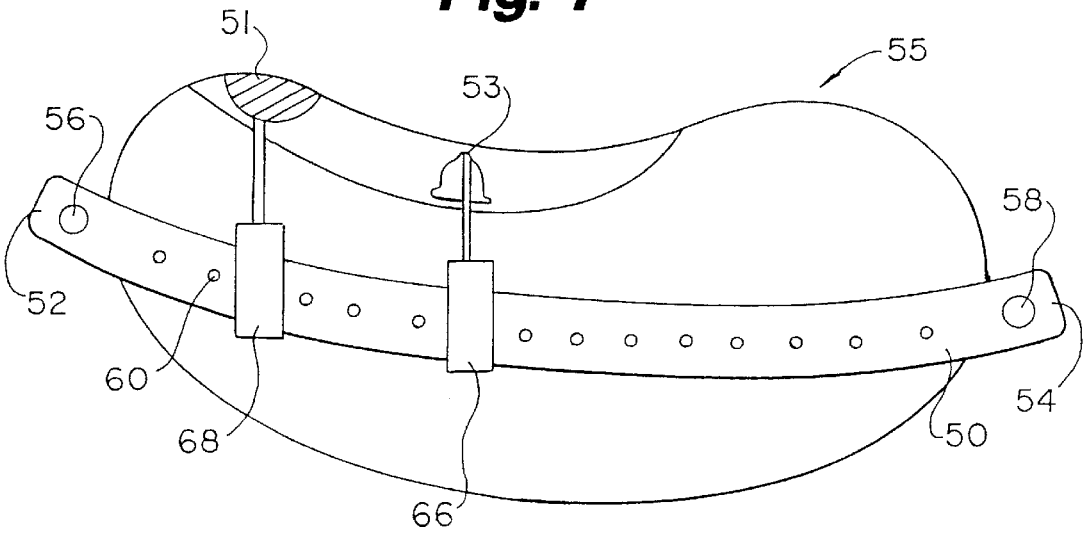
FIG. 7 is a perspective view of the embodiment of FIGS. 5 and 6 showing the supported devices.

FIGS. 5–7 provide a permanent embodiment of the current invention is also provided. The embodiment shown in FIGS. 5–7 is particularly suited as a bracket for mounting transducers. A specific use of the embodiment is to mount transducer in operable connection with the malleus 51 and the stapes 53.

As seen in FIG. 5, a flexible element 50 has first and second ends 52 and 54. The flexible element 50 is manufactured of a medical grade malleable material such as titanium. The element is placed into the floor of the mastoid 55 (shown after a mastoidectomy) and bent to conform to the floor. Permeable openings are provided along the length of the flexible element 50. The openings may be formed as holes 60 spaced uniformly or eccentrically along the flexible element 50. The exact configuration of the openings is unimportant so long as they are sufficiently permeable to allow adhesive to flow therethrough.

After placing the flexible strap 50 on the cortex, both ends 52 and 54 are secured to the cortex via fasteners, for example bone screws. To accommodate the bone screws, apertures 56 and 58 may be formed at either end.

Once the flexible strap 50 is secured to the cortex, an adhesive is applied such that it permeates the holes 60 provided along the length of the flexible strap 50. The adhesive is a medical adhesive such as polymethyl methacrylate PMMA, or PMA. Applying the adhesive to the flexible strap 50 creates a reinforced support on which to mount a transducer to contact an ossicle of the middle ear.

FIG. 6 illustrates the driver and sensor locations, 62 and 64 respectively, on the flexible strap 50. The adhesive remaining on the surface of the flexible strap 50 is allowed to cure to a pasty state. After the pasty state is reached, the driver and sensor transducers, 66 and 68 respectively, are positioned to contact the ossicles using positioning techniques and are placed in the adhesive along the flexible strap, as seen in FIG. 7. Optionally, the cure of the adhesive may be accelerated by "localizing" thermal heating of the interface between the adhesive and the flexible strap 50 and the interface between the adhesive and the transducer(s). However, cure may also be achieved without heat.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as encompassed by the scope of the appended claims.

What is claimed is:

1. A support assembly for use with a hearing assistance device comprising:

a device configured for mounting to a structure of the ear;

a flexible adjusting portion having two ends, a first end attachable to the device for mounting and a second end fixable to a base, the flexible adjusting portion being configured for removal after the device has been mounted to the structure of the ear;

a connection between the first end of the flexible adjusting portion and the device for mounting.

2. The support assembly of claim 1 wherein the flexible adjusting portion is manufactured of a malleable medical grade alloy.

3. The support assembly of claim 2 wherein the alloy is platinum.

4. The support assembly of claim 1 wherein the device is a transducer.

5. The support assembly of claim 1 wherein the base is the mastoid.

6. The support assembly of claim 1 wherein the connection further comprises a quick disconnect.

7. The support assembly of claim 1 wherein the connection further comprises an electromagnetic connector.

8. The support assembly of claim 1 wherein the connection further comprises a pin and socket assembly.

9. The support assembly of claim 1 further including a mounting plate connected to the second end of the adjusting portion.

10. The support assembly of claim 9 wherein the mounting plate is adapted for receiving one or more fasteners.

11. The support assembly of claim 10 wherein the one or more fasteners are bone screws.

12. The support assembly of claim 1 wherein the device for mounting is further supported by one or more legs for contact with a second base.

13. The support assembly of claim 12 wherein the second base is the mastoid floor.

14. The support assembly of claim 1 further including a hardenable fluent for securing the device to the ear structure.

15. The support assembly of claim 1 wherein the flexible adjusting portion is configured for removal.

16. A method of positioning and supporting a device to contact a structure of the ear comprising the steps of:

providing a support assembly having a flexible adjusting portion having two ends, a first end attached to the device and a second end fixable to a base and a connection between the first end of the flexible adjusting portion and the device, the flexible adjusting portion being configured for removal after the device has been mounted to the structure of the ear;

fixing the second end of the flexible adjusting portion to the base;

manipulating the flexible adjusting portion such that the device is in suitable contact with the structure of the ear;

setting the device in contact with the structure of the ear with an adhesive;

severing the connection between the first end of the flexible adjusting portion and the device; and unfixing the second end of the flexible adjusting portion from the base.

17. The method of claim 16 further including the steps of unfixing the second end of the flexible adjusting portion from the base and severing the connection between the first end of the flexible adjusting portion and the device.

* * * * *